US009163893B1

(12) United States Patent
Gutierrez

(10) Patent No.: US 9,163,893 B1
(45) Date of Patent: Oct. 20, 2015

(54) ADJUSTABLE RIFLE SUPPORT

(71) Applicant: Tommy Joe Gutierrez, Grandview, TX (US)

(72) Inventor: Tommy Joe Gutierrez, Grandview, TX (US)

( * ) Notice: Subject to any disclaimer, the term of this patent is extended or adjusted under 35 U.S.C. 154(b) by 0 days.

(21) Appl. No.: 14/281,467

(22) Filed: May 19, 2014

Related U.S. Application Data

(60) Provisional application No. 61/936,571, filed on Feb. 6, 2014.

(51) Int. Cl.

| | |
|---|---|
| ***F41A 23/02*** | (2006.01) |
| ***F41A 23/18*** | (2006.01) |
| ***F41A 27/22*** | (2006.01) |
| *F41A 27/24* | (2006.01) |

(52) U.S. Cl.
CPC ..... *F41A 23/02* (2013.01); *F41A 27/22* (2013.01); *F41A 27/24* (2013.01)

(58) Field of Classification Search
CPC ..... F41A 23/02; F41A 23/06; F41A 23/08; F41A 23/10; F41A 23/16; F41A 23/18
See application file for complete search history.

(56) References Cited

U.S. PATENT DOCUMENTS

| | | | | | |
|---|---|---|---|---|---|
| 1,195,055 | A | * | 8/1916 | McNeal | 89/37.04 |
| 1,233,638 | A | * | 7/1917 | Baerman | 248/292.12 |
| 4,026,057 | A | * | 5/1977 | Cady | 42/94 |
| 4,854,066 | A | * | 8/1989 | Canterbury, Sr. | 42/94 |
| 4,876,814 | A | * | 10/1989 | Lombardo | 42/94 |
| 4,924,616 | A | * | 5/1990 | Bell | 42/94 |
| 5,070,636 | A | * | 12/1991 | Mueller | 42/94 |
| 5,081,783 | A | * | 1/1992 | Jarvis | 42/94 |
| 5,173,563 | A | | 12/1992 | Gray | |
| 5,481,817 | A | * | 1/1996 | Parker | 248/286.1 |
| 5,755,411 | A | | 5/1998 | Strong, III et al. | |
| 5,778,589 | A | * | 7/1998 | Teague | 42/94 |
| 5,811,720 | A | * | 9/1998 | Quinnell et al. | 89/37.04 |
| 5,964,435 | A | | 10/1999 | Peltier | |
| 6,272,785 | B1 | * | 8/2001 | Mika et al. | 42/94 |
| 6,338,218 | B1 | * | 1/2002 | Hegler | 42/94 |
| 6,526,687 | B1 | * | 3/2003 | Looney | 42/94 |
| 6,637,708 | B1 | * | 10/2003 | Peterson | 248/285.1 |
| 7,086,192 | B2 | * | 8/2006 | Deros | 42/94 |
| 7,188,445 | B2 | * | 3/2007 | Lehman | 42/94 |
| 7,313,884 | B2 | | 1/2008 | Eddins | |
| 7,356,960 | B1 | * | 4/2008 | Knitt | 42/94 |
| D605,246 | S | * | 12/2009 | Hobbs | D22/108 |
| 7,770,319 | B2 | * | 8/2010 | McDonald | 42/94 |
| 8,096,077 | B1 | * | 1/2012 | Caywood | 42/94 |
| 8,544,202 | B2 | * | 10/2013 | Bastian, Jr. | 42/94 |
| 8,590,440 | B2 | | 11/2013 | Gallo | |
| 2002/0040544 | A1 | * | 4/2002 | Muhlestein | 42/94 |
| 2004/0134113 | A1 | * | 7/2004 | Deros et al. | 42/94 |
| 2008/0202326 | A1 | * | 8/2008 | Carroll et al. | 89/38 |
| 2009/0026679 | A1 | * | 1/2009 | Harman, III | 269/43 |

(Continued)

*Primary Examiner* — Bret Hayes
*Assistant Examiner* — Derrick Morgan
(74) *Attorney, Agent, or Firm* — Whitaker Chalk Swindle & Schwartz PLLC; Stephen S. Mosher

(57) ABSTRACT

An adjustable rifle support for use on a window sill of a blind or similar structure includes three main parts or assemblies: an elongated member having a forward end and a rearward end; a forward support assembly attached to the forward end and a rearward support assembly on the rearward end of the elongated member. The adjustable rifle support further includes five adjustments, all of which may be adjusted without tools, while the shooter is in position for aiming and shooting the rifle.

22 Claims, 7 Drawing Sheets

(56) References Cited

U.S. PATENT DOCUMENTS

| | | | | |
|---|---|---|---|---|
| 2009/0277068 | A1 | 11/2009 | Lamar | |
| 2010/0223832 | A1 | 9/2010 | Lombardi | |
| 2010/0301184 | A1* | 12/2010 | Stabler | 248/346.5 |
| 2011/0094140 | A1* | 4/2011 | Letson | 42/94 |
| 2011/0113670 | A1* | 5/2011 | Stafford et al. | 42/94 |
| 2012/0017485 | A1* | 1/2012 | Kern | 42/94 |
| 2012/0294672 | A1* | 11/2012 | Hicks | 403/299 |
| 2014/0352193 | A1* | 12/2014 | Bull | 42/94 |

* cited by examiner

ADJUSTABLE RIFLE SUPPORT

RELATED APPLICATIONS

This application claims priority to U.S. Provisional Patent Application No. 61/936,571 filed Feb. 6, 2014 and entitled WINDOW/WALL MOUNT RIFLE SHOOTING ASSISTANT DEVICE, filed in the name of Tommy Joe Gutierrez, the inventor of the present non-provisional patent application.

BACKGROUND OF THE INVENTION

1. Field of the Invention

The present invention generally relates to accessory equipment to facilitate hunting game with a rifle and more particularly to portable and adjustable apparatus for providing stable support of a rifle.

2. Background of the Invention and Description of the Prior Art

Shooting game with a rifle relies substantially on the ability of the shooter to support the rifle in a steady or stable position to achieve maximum accuracy. The advantage of the long barrel of the rifle to align the trajectory of the round becomes a disadvantage if the rifle is not held in a fixed position after it is aimed at the target and while the trigger is squeezed to fire the round. It is often the case that resting the barrel of the rifle on a fixed object such as a tripod, table, a rock, or some other stationary object enhances the ability to fire a round at a target with improved accuracy. For example, shooting from a blind that has a solid widow frame is one common example of such a fixed object. Other examples include a hunting stand railing or ledge or window, and the like. Nevertheless, the rifle when aimed must still be supported by the shooter in alignment with the target. This can be difficult for a number of reasons such as strong winds, a rifle that is too heavy to hold steady (for instance, young shooters or shooters of small stature), nervousness, a physical disability that impairs proper technique, etc.

A number of efforts to provide stable support for a shooter's rifle in the window or other opening in a blind structure or similar context have been devised in the prior art. Several representative examples include U.S. Pat. No. 7,313,884 issued to Eddins, U.S. Pat. No. 7,188,445 issued to Lehman, and U.S. Pat. No. 5,964,435 issued to Peltier, all characterized by limited adjustment and adaptability to shooting environments, require the use of tools to make the adjustments, etc.

What is needed is an adjustable rifle support that overcomes the shortcomings of the prior art, is portable and easy to install and adjust without tools, permits a wide variety of adjustments, and is adaptable to a variety of window frames in a variety of blinds, shelters, walls, etc.

SUMMARY OF THE INVENTION

Accordingly an adjustable support apparatus for a rifle in a shooting position, for example in a window of a wall, comprises an elongated member having a forward end including a first pivot part and a rearward end; a forward support assembly pivotably attached to the forward end of the elongated member; and a rearward support assembly slidingly installed on the rearward end of the elongated member. The forward assembly includes an adjustable clamp mechanism for supporting the rifle on a sill member of a window, a rifle barrel support, and adjustments for elevation and azimuth of the longitudinal axis of the rifle. The rearward assembly includes a rifle stock support for resisting recoil and adjustments for the length and height of the rifle.

In one aspect the forward assembly further comprises a second rigid member having a second pivot part extending rearward from the lower end thereof and the adjustable clamp mechanism attached at its upper end for supporting the apparatus securely on a window sill; an adjustable horizontal brace connected to the second rigid member above the lower end thereof for adjusting the elevation angle of the rifle; and the second pivot part is configured to cooperate with the first pivot part of the elongated member in pivotably supporting the forward end to enable adjustment of the azimuth angle of the elongated member.

In another aspect, the rearward assembly comprises an adjustment collar with a set screw, the collar configured for sliding along the elongated member for adjusting the position of the rearward assembly along the elongated member, the collar further having a first threaded rod extending upward from the collar; a stock support for retaining the rifle stock and limiting side-to-side and rearward motion thereof, and a second threaded rod of opposite thread from the first threaded rod extending downward from the stock saddle; and a turnbuckle coupling for joining distal ends of the first and second threaded rods for adjusting the distance between the collar and stock saddle, such that the stock saddle is positioned above the collar and elongated member, to adjust the height of the rifle stock relative to the elongated member.

In another aspect, the adjustable clamp mechanism comprises a vise formed by a fixed jaw at the upper end of the second rigid member and a movable jaw slidingly disposed along a horizontal rail extending forward from the fixed jaw, wherein the movable jaw and a downward extension thereof is caused to move along the horizontal rail by a first adjusting screw connecting the fixed jaw to matching internal threads in the movable jaw, to enable clamping a window sill in the vise.

In another aspect, the rifle barrel support comprises a U-shaped yoke extending upward from a swiveling post disposed on top of the adjustable clamp mechanism.

In another aspect, an adjustment for elevation comprises a horizontal brace disposed across the forward side of the second rigid member and below the upper end thereof, the brace movable forward or rearward by an adjusting screw turned by a second adjusting knob to adjust the distance between the lower end of the second rigid member and the wall below the window sill, thereby varying the angle of elevation of the longitudinal axis of the elongated member.

DETAILED DESCRIPTION OF THE INVENTION

The present invention achieves an advance in the state of the art of adjustable rifle supports in a design that has a number of advantages. Among these is, first, the ability to conveniently install, support, and adjust the position of the rifle without tools, while sighting the rifle in alignment with the intended target. Large adjustment knobs permit easy, rapid, and quiet adjustments to be made to the azimuth and elevation of the rifle. Once installed and the rifle is in position ready to shoot, these advantages further include (1) the rifle is retained in position; (2) the shooter does not have to support the weight of the rifle when making the shot; (3) adjustments can easily be made by the shooter without taking his or her eyes off the target; (4) the range of adjustments includes a substantial horizontal swing in the azimuth, either to improve the aim of the rifle or to gain more room inside the blind; (5) both ends of the rifle—the muzzle and the stock—are supported in respective components that are independently adjustable; (6) the rifle is well-secured in the support; and (7) the recoil when the rifle is fired is well-suppressed by the rifle stock rest. As with any rifle supporting structure, it is best practice to ensure that the safety is in an ON position when making adjustments and until it is ready to shoot.

Briefly stated, the adjustable rifle support to be described herein includes three main parts or assemblies. These include: an elongated member having a forward end including a first pivot part and a rearward end; a forward support assembly pivotably attached to the forward end of the elongated member; and a rearward support assembly slidingly installed on the rearward end of the elongated member. The elongated member or bar comprises a first rigid bar preferably having a rectangular or triangular cross section, a length similar to a substantial portion of the length of the rifle to be supported by the apparatus, and a first pivot part at the forward end of the rigid bar. When installed in a typical hunting blind or similar structure, the longitudinal axes of both the elongated member and the rifle are positioned in a substantially horizontal orientation. The forward assembly includes an adjustable clamping device for supporting the rifle on a sill member of a window, a rifle barrel support, and adjustments for elevation and azimuth of the longitudinal axis of the rifle. The rearward assembly includes a rifle stock support for securing the rifle stock, for resisting recoil of the rifle, and adjustments for the length and height of the rifle.

Figure 1:
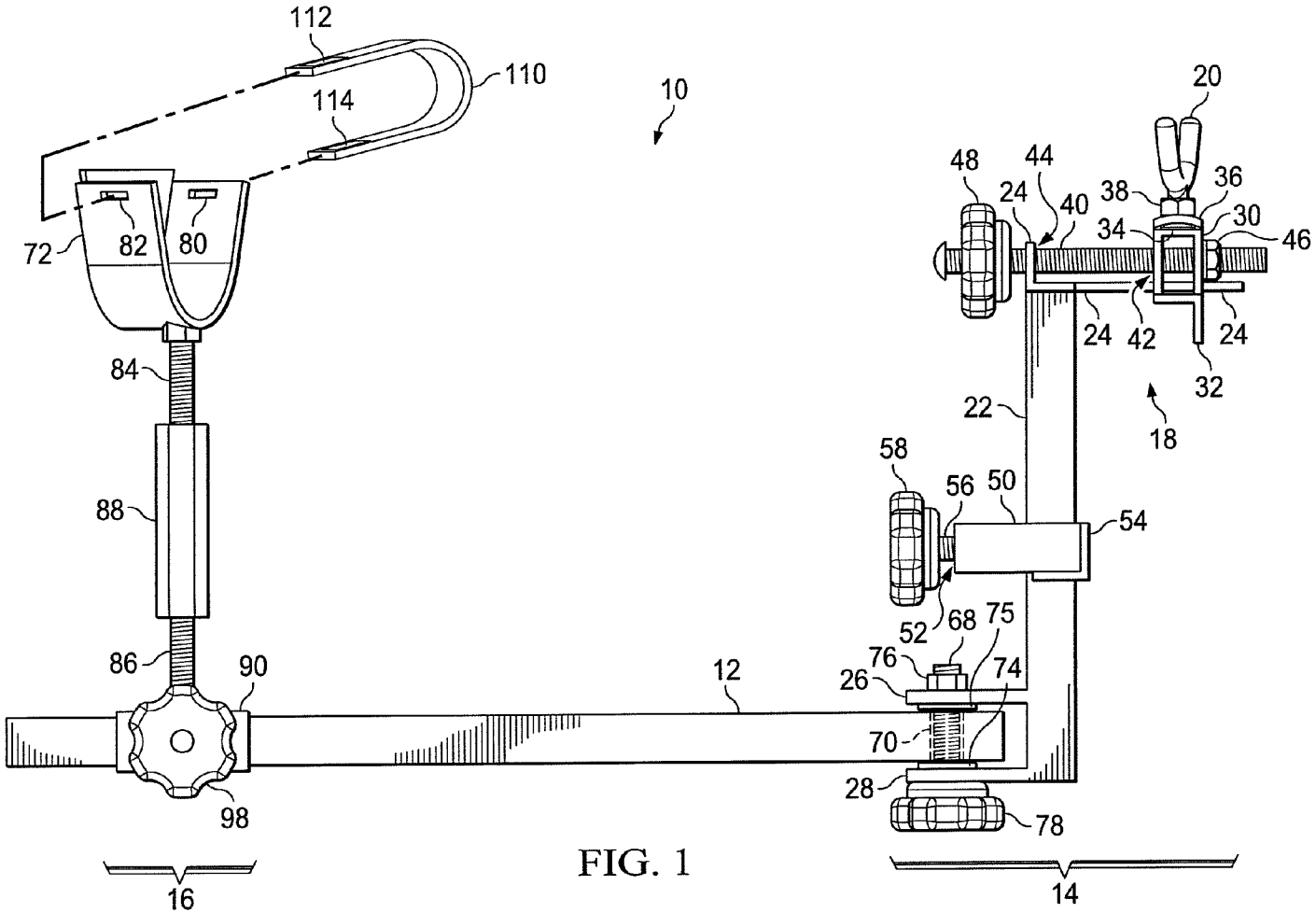
FIG. 1 illustrates a side view of an adjustable rifle support according to one embodiment of the invention.

FIG. 1 illustrates a side view of an adjustable rifle support 10 according to one embodiment of the invention. As shown the invention is an assembly of several structures: an elongated member 12, a forward support assembly 14 (See FIG. 2 and FIGS. 2A and 2B) pivotably mounted on a forward end of the elongated member 12, and a rearward support assembly 16 (See FIG. 3) slidingly mounted on a rearward end of the elongated member 12. The elongated member 12 will also be referred to as a first rigid member 12 in the following description. Structures appearing in more than one figure bear the same reference number throughout all of the drawings. While the drawings depict features of the invention in its approximate proportions, they are not precisely to scale because of the limitations of the page size.

A prototype was constructed using the following materials: the elongated (first rigid) member and the second rigid member 22 are formed from ¾ inch square, hollow steel tubing having a wall thickness of approximately 0.060 inch. The first and second adjustment collars 50, 90 may similarly be formed of 1 inch square hollow steel tubing having a wall thickness of approximately 0.060 inch. The second pivot parts 26, 28, the fixed jaw 24, and the rifle stock support 72 are formed of ¾ inch wide strap or steel plate approximately 0.150 inch thick. The movable jaw 30, 32, and the horizontal brace 54 may be formed of ¾ inch steel angle stock having a wall thickness of approximately 0.060 inch. In this illustrative example the threaded rods, bolts, screws, and nuts are all ⅜ inch diameter having a thread pitch of 16 threads per inch. In the prototype shown, the ⅜ inch×16 nuts may be welded to their associated structural element. The knobs used may be a stock molded plastic available from hardware outlets. Other structural parts may also be suitably welded to their adjoining structures. The turnbuckle coupling is a length of hex cross section steel bar bored and tapped at each end to join with the ⅜ inch×16 bolts. Persons skilled in the art will recognize that a variety of materials, components, and construction techniques well-known to them may be used to fabricate the adjustable rifle support apparatus described herein with out departing from the principles of the invention as set forth in the appended claims.

The prototype adjustable rifle support apparatus was constructed to adapt to relatively small rifles of the size that can be handled by a pre-teen youngster. Accordingly, the illustrative example shown in the figures may be approximately 34 inches long and have an overall height of approximately 10 inches. However, the design may be readily scaled to fit any size rifle. Moreover, the materials used may be substituted by other materials or dimensions suitable for the structural requirements of the assemblies shown herein.

Figure 2:
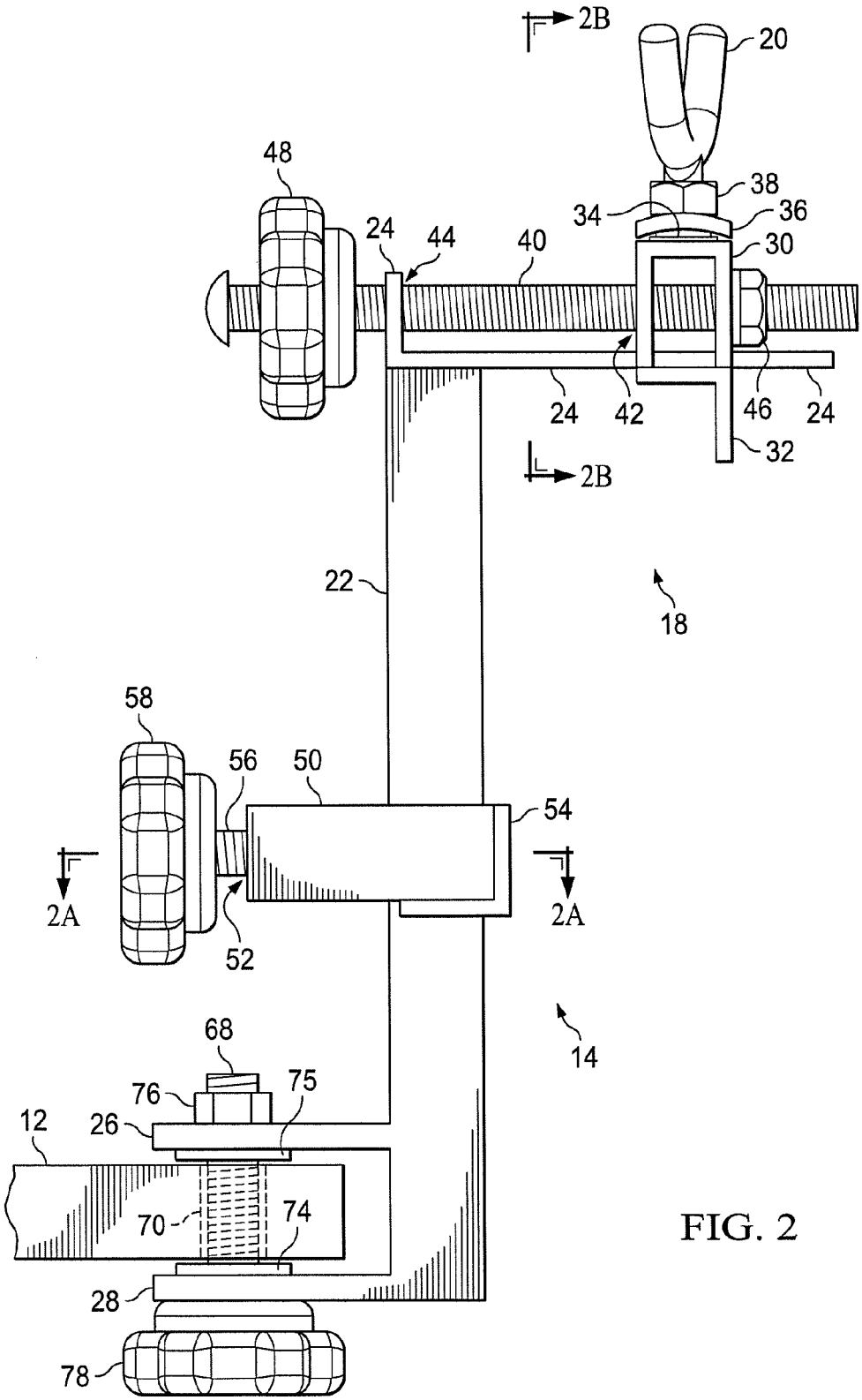
FIG. 2 illustrates a detail side view of a forward assembly portion of the embodiment of FIG. 1.

FIG. 2 illustrates a detail side view of a forward support assembly 14 portion of the embodiment of FIG. 1. The forward support assembly includes a clamp mechanism 18 attached to an upper end of a second rigid member 22, an adjustable horizontal brace 54 connected to the second rigid member 22 above the lower end thereof for adjusting the elevation angle of the rifle 140, and a second pivot part 26, 28 (corresponding to first and second pivot arms 26, 28) configured to cooperate with the first pivot part 70 (also called a "pivot hole" 70 herein) at the forward end of the elongated member 12 in pivotably supporting the forward end thereof to enable adjustment of the azimuth (compass bearing) angle of the elongated member 12. The first pivot part 70, disposed vertically through the forward end of the elongated member 12, is provided to receive a pivot pin or pivot bolt 68, which may be a ⅜ inch×16 bolt affixed to a control knob 78 for ease of adjustment as will be described.

The second pivot part in this illustrated example is the combination of the first 26 and second 28 pivot arms attached to the lower end of the second rigid member 22. A fourth adjusting knob 78 is shown that may be tightened and loosened in the threads of a pivot nut 76 attached to the upper pivot arm 28 in alignment with the first pivot part 70. The pivot nut 76 may be, e.g., welded to the arm 28. A flat washer 74 may be placed between the underside of the elongated member 12 and the upper side of the pivot arm 28 to minimize friction as the elongated member 12 is swung side-to-side while adjusting the azimuth angle or merely swinging the elongated member to one side out of the way when the adjustable rifle support is not in use. A second flat washer 75 may be positioned between the upper side of the elongated member 12 and the underside of the pivot arm 26 to stabilize the motion of the elongated member 12. The third adjusting knob 78 is provided to tighten or loosen the first and second pivot parts. It is to be noted that the adjustable rifle support 10 described and illustrated herein includes five adjustments (to be described), all of which may be adjusted without tools, while the shooter is in position for aiming and shooting the rifle 140, simply by turning one of the adjustment knobs 48, 58, 78, 98, and the turnbuckle coupling nut 88. This is one of the principal advantageous features of the present invention. In the description that follows, the adjustments are identified as first adjusting knob 48, second adjusting knob 58, third adjusting knob 78, fourth adjusting knob 98, and turnbuckle adjustment 88.

Figure 2A:
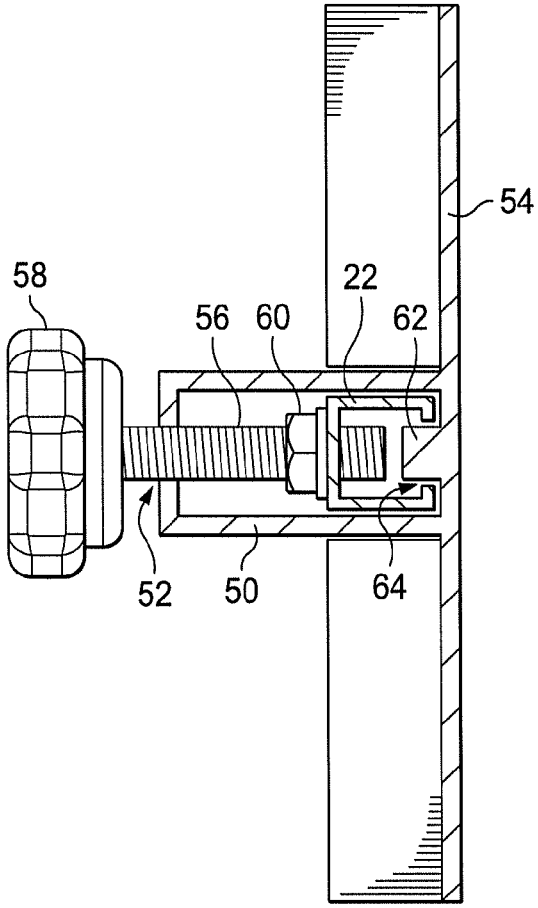
FIG. 2A illustrates a plan view detail of a portion of FIG. 2 that depicts the horizontal brace assembly.
Figure 5:
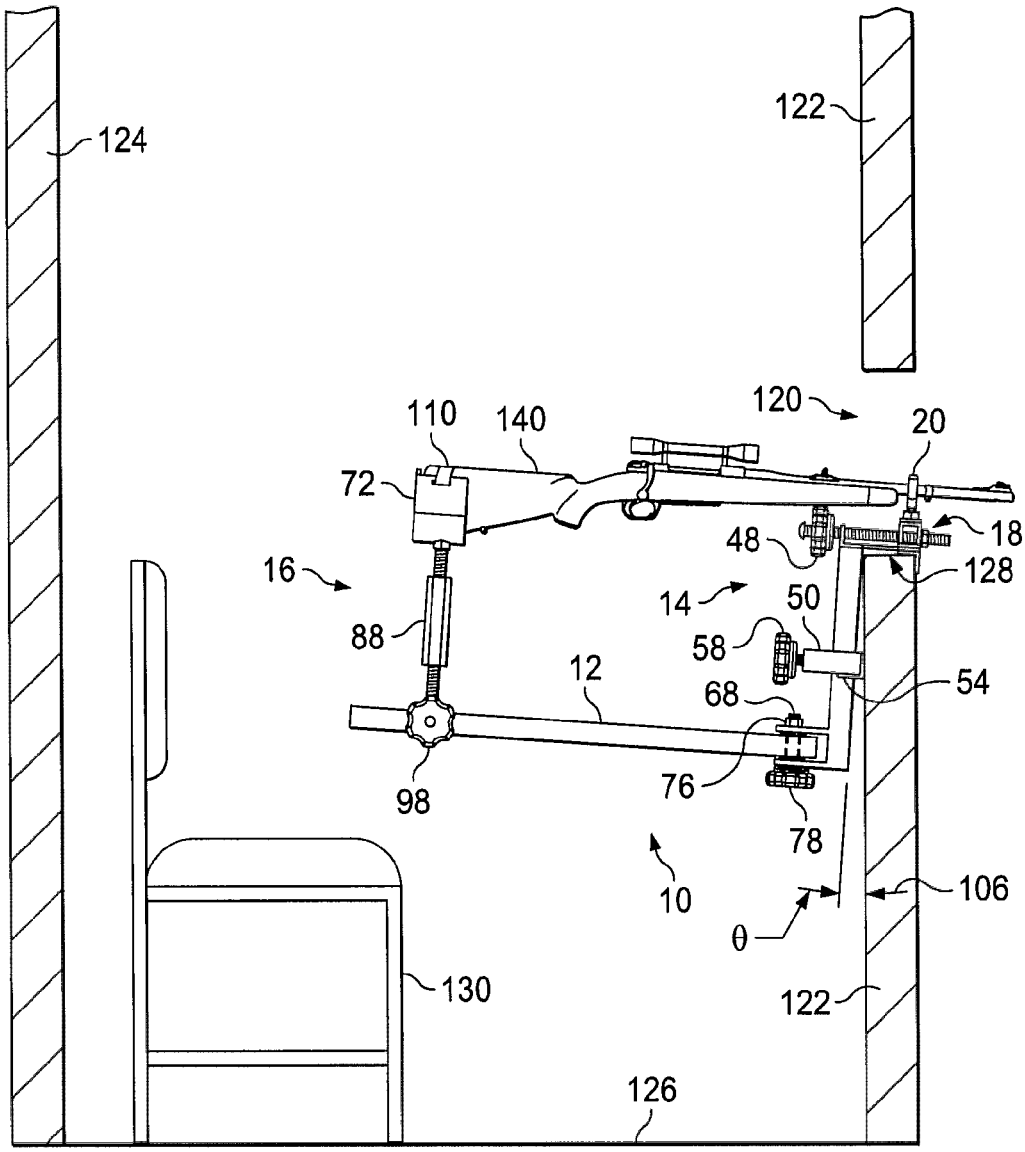
FIG. 5 illustrates a side view of one example of installation and use of the embodiment of FIG. 1.

Referring to FIGS. 1, 2, and 2A, the horizontal brace 54 is attached to a first adjustment collar 50 that is supported at a position along the second rigid member 22 by a pin 62 that extends through an opening 64 in a forward side of the second rigid member 22. The left and right sides of the first adjustment collar 50 (See FIG. 2A) permit it to be moved forward and backward relative (perpendicular) to the second rigid member 22 by turning the second adjusting knob 58 that is attached to the second adjusting screw 56 clockwise or counterclockwise. The second adjusting screw 56 cooperates with a threaded hole 60 in the proximate side of the second rigid member 22. The threaded hole 60 may be provided by a nut welded to the proximate side of the second rigid member 22. The clockwise action of the second adjusting screw 56 causes the first adjusting collar 50 to displace the horizontal brace 54 that is attached to the collar 50 forward and away from the second rigid member 22. The counterclockwise action of the second adjusting screw 56, by turning the second adjusting knob 58 causes the first adjusting collar 50 to displace the horizontal brace 54 rearward and toward the second rigid member 22. These adjustments made by turning the second, adjusting knob 58 may be used to change the angle the second rigid member 22 makes with the surface of the wall 122 below the window opening 120 of a hunter's blind, as depicted in FIG. 5. This adjustment may be made to refine or trim the angle of elevation relative to the horizon or to adjust for a non-vertical wall 122 below the window sill 128.

Figure 2B:
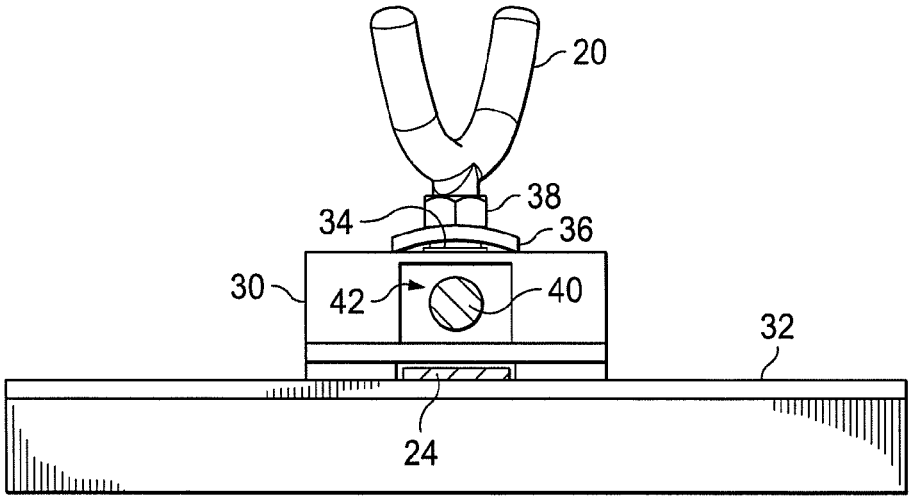
FIG. 2B illustrates an elevation view detail of a portion of FIG. 2 that depicts the movable jaw assembly.

Referring to FIGS. 2 and 2B, the action of the clamp mechanism 18 will be described. The clamp mechanism 18 may be configured as a vise having a fixed jaw 24 and a movable jaw 30 (with its downward extension 32) operable by turning a vise screw 40. The fixed jaw 24 may be configured as an L-shaped member with the short leg disposed vertically atop the upper end of the second rigid member 22 and the long leg—configured as a horizontal rail or tongue—of the L-shape extending horizontally, tongue-like, in a forward direction. In this example, the L-shaped member-fixed jaw 24 is attached by welding it to the upper end of the second rigid member 22. The forward direction is defined in the drawing sheets as toward the right hand side of the sheet. The first adjusting knob 48 may be used in this embodiment to move the movable jaw 30, 32 via the vise screw 40 toward or away from the fixed jaw 24 and secure the vise portion of the clamping mechanism 18 in its tightened position when the clamp mechanism 18 is secured to a window sill 128 (See FIG. 5) or similar structural feature of a hunter's blind and the like. The vise screw 40 shown in the drawings (See FIGS. 2 and 2B) passes through a hole 44 in the fixed jaw 24 and is threaded through an opening 42 in the proximate side of the movable jaw 30 and thence, in this example, into a nut 46 welded to the backside of the movable jaw 30. In alternate embodiments, for example, the movable jaw 30 could be tapped with the appropriate threads instead of using the ⅜ inch×16 nut as shown in FIG. 2.

Continuing with FIGS. 1, 2, and 2B, mounted on the upper surface of the movable jaw 30 is a Y-shaped (or U-shaped in some embodiments, for example), rifle barrel support 20. The rifle barrel support 20 includes a downward extending post that is supported at its lower end within an assembly of a cupped washer 36 beneath a collar 38 having an inside diameter slightly greater than the diameter of the post extension of the rifle barrel support 20. In the figure the collar 38 is shown as a ⅜×16 nut that was used in the prototype. A flat disc 34 is fixed to the lower end of the rifle barrel support 20 to retain the rifle barrel support 20 within the assembly 36, 38 while allowing the rifle barrel support 20 to swivel. The arms of the rifle barrel support 20 may be covered or coated with a resilient material such as a spray-on latex or plastic or rubber tubing (not shown) to provide some degree of cushioning of the barrel of a rifle 140 installed in the adjustable rifle support 10 described herein. In operation the movable jaw assembly 30, 32 and rifle barrel support 20 (which move as a unit) slides along the extended portion of the fixed jaw 24 when the vise screw 40 is adjusted.

Figure 3:
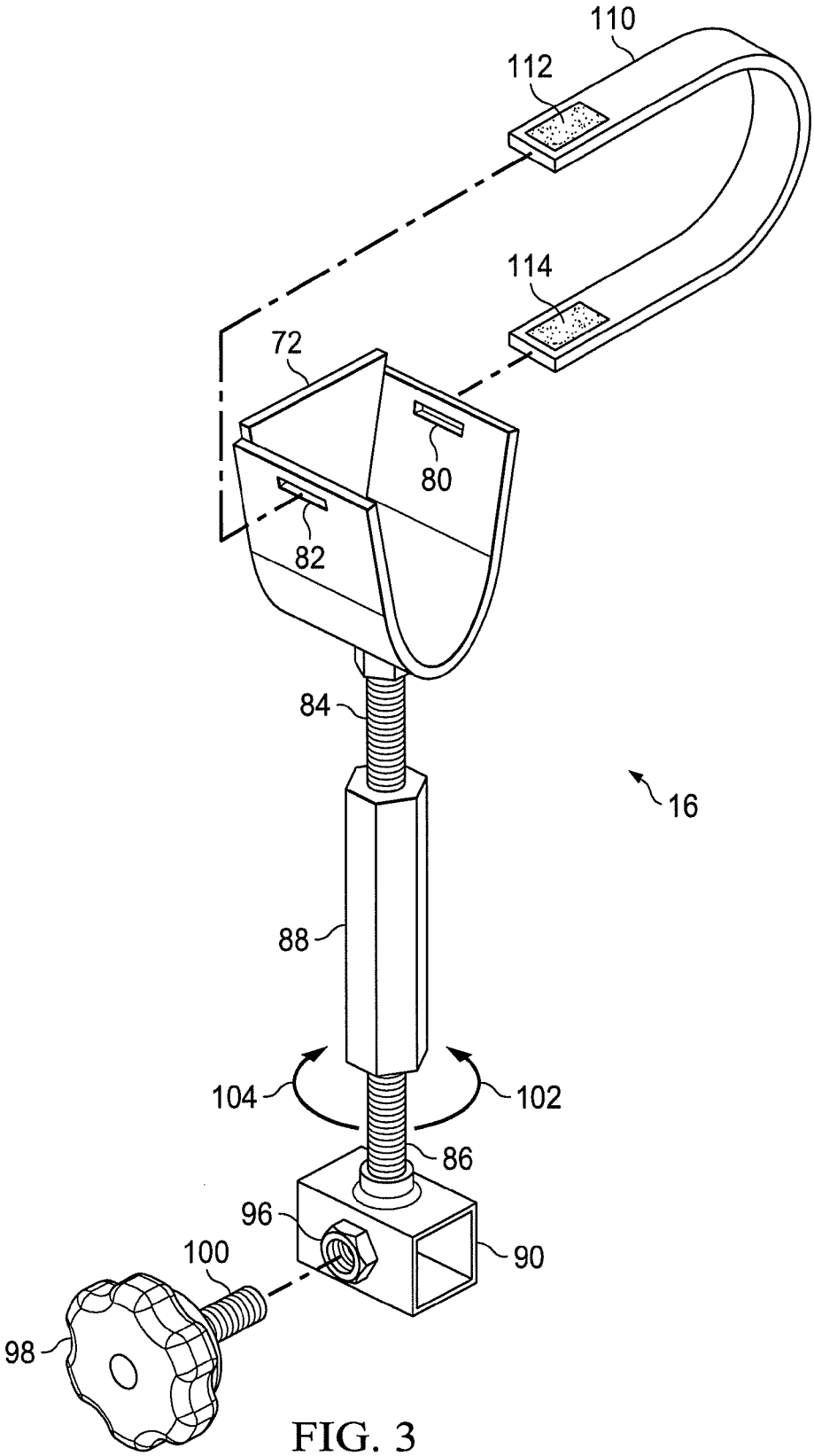
FIG. 3 illustrates a detail side view of a rearward assembly portion of the embodiment of FIG. 1.

FIG. 3 illustrates a detail side view of a rearward support assembly 16 portion of the embodiment of FIG. 1. A rifle stock support 72 is shown supported by a turnbuckle assembly 84, 86, 88 upon a second adjusting collar 90. The second adjusting collar 90 is configured to slide along the elongated member 12 to position the rifle stock support 72 to adapt to the length of the rifle 140 (See FIG. 5). A fourth adjusting knob 98 having a set screw 100 (or, in this example, a bolt or threaded rod having a ⅜ inch×16 thread) attached thereto may be threaded through the side of the second adjusting collar 90 to provide for loosening, adjusting, and tightening the position of the second adjusting collar 90. The height of the rifle stock support 72 relative to the axis of the elongated member 12 is adjusted using the turnbuckle assembly 84, 86, 88. The left hand thread of rod 84 may be provided by a ⅜ inch×16 bolt welded to the underside of the rifle stock support 72 with the threaded end disposed in a downward direction. The right hand thread of rod 86 may be provided by a ⅜ inch×16 bolt welded to the upper side of the second adjusting collar 90 with the threaded end disposed in an upward direction. The bolt 84 and the bolt 86 are joined at their distal ends by the elongated turnbuckle coupling nut 88, also called the fifth adjusting handle 88. The turnbuckle coupling nut 88 may be formed as an elongated hex nut having a ⅜ inch×16 thread.

To make an adjustment, turning the turnbuckle coupling nut 88 to the right (see arrow 102) extends the length of the turnbuckle assembly 84, 86, 88 and raises the height of the rifle stock support 72. Turning the turnbuckle coupling nut 88 to the left (see arrow 104) shortens the length of the turnbuckle assembly 84, 86, 88 and lowers the height of the rifle stock support 72. The stock of the rifle 140 may be secured in the rifle stock support 72 using a strap 110 and fasteners 112 and 114 at the ends thereof. In one embodiment the fasteners may be the two parts of a hook and loop fastener, a mechanical snap, a buckle assembly, first and second tying strings (not shown) etc. In lieu of the strap and fasteners 112, 114, a stout rubber band or simply a length of rope would even be suitable as a temporary measure. In some versions of the rifle stock support 72, it may be lined with a cushioning material such as leather, felt, synthetic foam sheet, etc. These examples are not intended to be limiting but, as recognized by persons skilled in the art, are illustrative of components that serve the function required.

Figure 4:
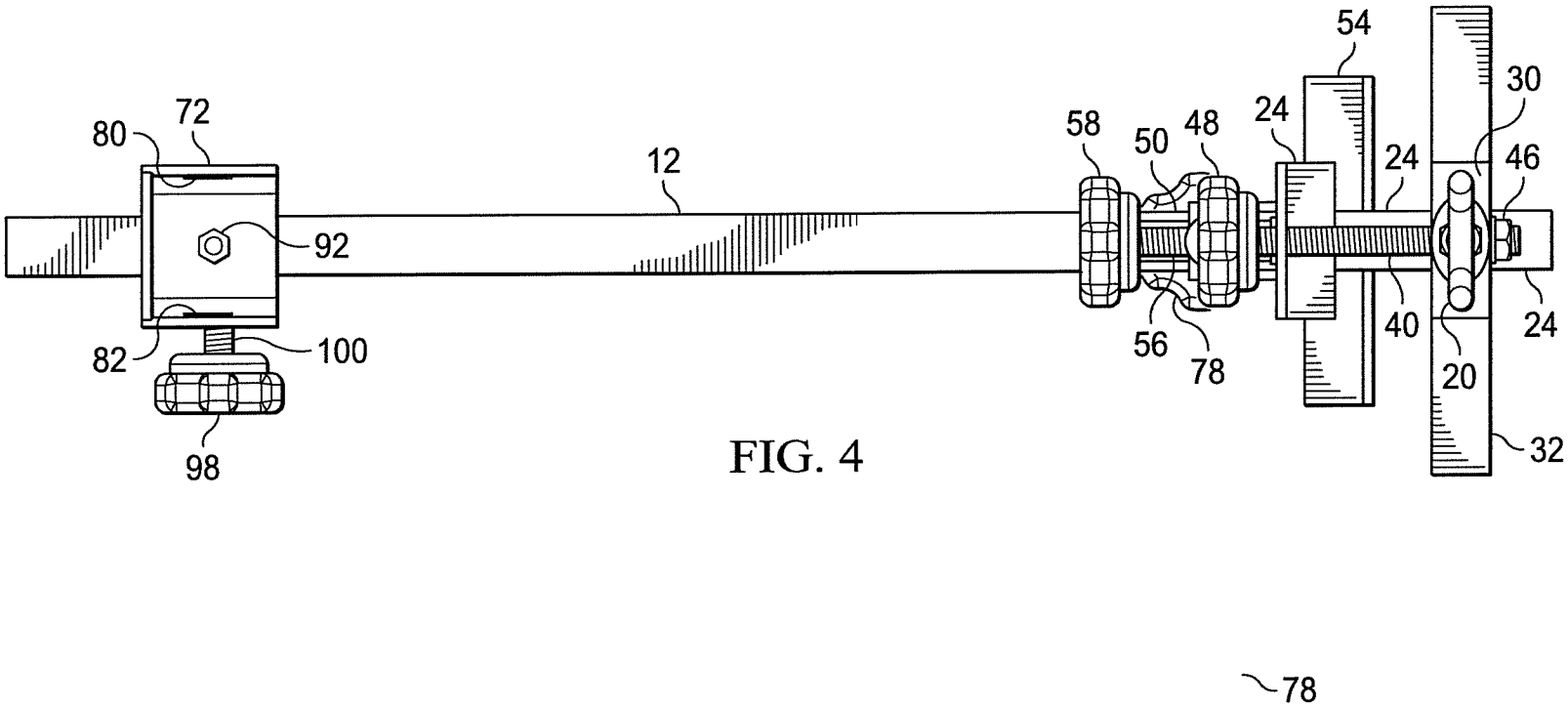
FIG. 4 illustrates a plan view from above of the embodiment of FIG. 1.

FIG. 4 illustrates a plan view from above of the embodiment of FIG. 1 to show the shape of the fixed 24 and movable 30 jaws, the horizontal brace 54, and the rifle stock saddle 72, and to depict the relationship of the first 48, second 58, third 78, and fourth 98 adjusting knobs when seen from above. All of the reference numbers shown in FIG. 4 coincide with the reference numbers for the same structural components shown in the FIGS. 1, 2, 2A, and 2B.

FIG. 5 illustrates a side view of one example of installation and use of the embodiment of FIG. 1 installed in a hunter's blind or but 122, 124, 126 with a rifle 140 installed on the adjustable rifle support apparatus. As shown, the forward clamp mechanism 18 is placed on the sill of the window 120 of the blind 122, 124, 126, and the jaws 24 and 30 secured to the sill by tightening the first adjusting knob 58. The length of the support apparatus 10 is adjusted using the third adjusting knob 98. The height of the rifle stock may be adjusted using the turnbuckle coupling 88. In the next step the rifle may be positioned and secured in the supports 20, 78. Then the angle of elevation from horizontal of the rifle may be adjusted using the second adjusting knob 58 to position the horizontal brace 54 closer to the wall 122 (increasing the adjustment angle 106) to raise the stock end of the rifle 140, or farther from the wall 122 (reducing the adjustment angle 106) to lower the stock end of the rifle 140. The elevation may also be influenced by adjusting the turnbuckle coupling 88. Finally, the azimuth or compass bearing of the rifle may be adjusted by loosening the third adjusting knob 78 (see also FIGS. 1 and 2) to enable swinging the adjustable rifle support 10 (+/− up to at least 30 to 40 degrees) about the pivot pin 70 retained in the second pivot part 26, 28 at the forward end of the elongated member 12.

Figure 6A:
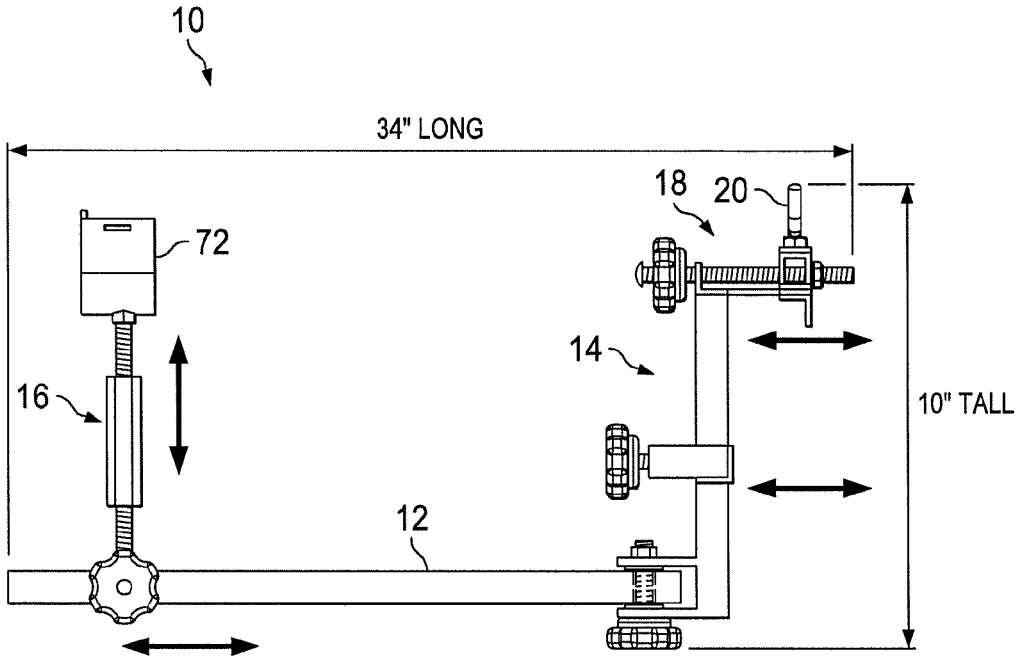
FIG. 6A illustrates a side view of the embodiment of FIG. 1 depicting the range of adjustment of the forward and rearward assemblies.
Figure 6B:
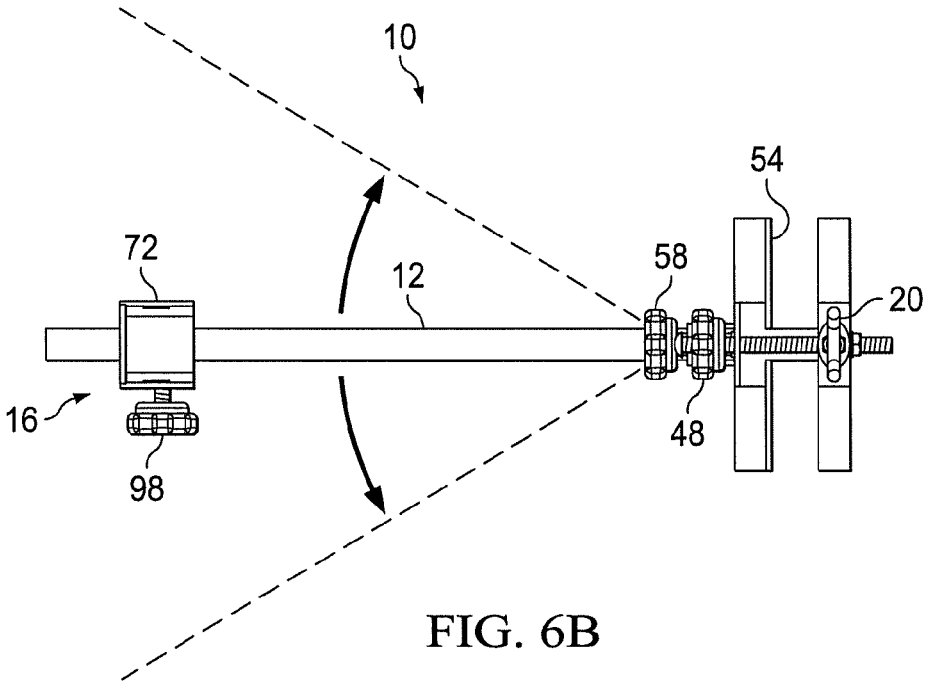
FIG. 6B illustrates a plan view of the embodiment of FIG. 1 depicting the range of azimuth adjustment of the elongated member and rearward assembly relative to the forward assembly.

The foregoing adjustments are illustrated in FIGS. 6A and 6B to clarify the direction of movement permitted by the apparatus 10. FIG. 6A illustrates a side view of the embodiment of FIG. 1 depicting the range of adjustment of the forward and rearward assemblies; and FIG. 6B is similar to FIG. 4 but including depicting the range of azimuth adjustment of the elongated member and rearward assembly relative to the forward assembly. It is readily seen that the rifle 140 may be moved in both directions in all three planes to facilitate aiming the rifle 140. Further, the adjustable rifle support 10 provides for securing each adjustment from windblown or inadvertent movement of the rifle 140. When thus positioned and the adjustments secured, the rifle 140 is in position to be fired at the intended target. The shooter does not have to support the rifle 140 or be concerned about inadvertent movement if of the rifle 140.

A recommended adjustment procedure is as follows. After installing the adjustable rifle support on a window sill 128 (ledge, or similar structure) by placing the clamp mechanism 18 over the sill or ledge 128, (A) tighten the first adjustment knob 48 to secure the support on the sill or ledge 128. (B) Set the initial angle of the elongated member 12 to approximately a right angle with the sill or ledge 128 by orienting the member 12 and tightening the pivot bolt 68 with third adjusting knob 78, into pivot nut 76. This adjustment can be refined later. (C) Adjust the position of the rifle stock support 72 for the length of the rifle 140 by positioning the second adjusting collar 90 along the elongated member 12 and setting it with the fourth adjusting knob 98. It may be helpful to hold the rifle 140 in its approximate position to gauge the appropriate position of the rearward support assembly 16 along the elongated member 12. (D) Place the muzzle end of the rifle 140 in the rifle barrel support 20 and the butt end of the rifle 140 in the rifle stock support 72. The stock of the rifle 140 may then be secured with the strap 110 passed through the slots 80, 82 and fastening the ends 112, 114 of the strap 110 together. (E) Adjust the turnbuckle coupling nut 88 (a.k.a. the fifth adjusting handle 88) to raise or lower the rifle stock end of the rifle 140 to level the axis of the rifle 140 or adjust the elevation angle of the rifle 140. (F) Adjust the second adjusting knob 58 of the horizontal brace 54 to make slight adjustments to the elevation angle of the rifle 140 or to compensate for a non-plumb wall 122. (G) Adjust the compass bearing or azimuth angle of the rifle by loosening the third adjusting knob 78 and swinging the elongated member 12 to the desired orientation, then tighten the third adjusting knob 78. (H) Proceed to fine tune the adjustments as needed by adjusting the adjustments controlled by the first, second, third, and fourth knobs 48, 58, 78, and 98, and the turnbuckle coupling nut or fifth adjusting handle 88.

The foregoing description discloses an adjustable rifle support that includes three main parts or assemblies. These include: an elongated member having a forward end including a first pivot part and a rearward end; a forward support assembly pivotably attached to the forward end of the elongated member; and a rearward support assembly slidingly installed on the rearward end of the elongated member. The adjustable rifle support further includes five adjustments, all of which may be adjusted without tools, while the shooter is in position for aiming and shooting the rifle 140, simply by turning one of the adjustment knobs 48, 58, 78, 98, and the turnbuckle coupling nut 88. The advantages provided by this novel apparatus are (1) the rifle is retained in position; (2) the shooter does not have to support the weight of the rifle when making the shot; (3) adjustments can easily be made by the shooter without taking his or her eyes off the target; (4) the range of adjustments includes a substantial horizontal swing in the azimuth, either to improve the aim of the rifle or to gain more room inside the blind; (5) both ends of the rifle—the muzzle and the stock—are supported in respective components that are independently adjustable; (6) the rifle is well-secured in the support; and (7) the recoil when the rifle is fired is well-suppressed by the rifle stock rest.

While the invention has been shown in only one of its forms, it is not thus limited but is susceptible to various changes and modifications without departing from the spirit thereof. Although threaded nuts are, in the illustrated example, welded to certain structural components, other means for providing the threaded holes to receive the associated bolts or threaded rods in the adjusting mechanisms may be used if sufficient material thickness is provided. Further, the particular diameter and thread pitch of the bolts and threaded receptacles may be altered to accommodate particular applications. Moreover, the components depicted and described herein may be modified yet still embody the principles of the invention, which provides a portable device that has many adjustable features for adjusting the disposition of a rifle when mounted upon or in a fixed structure.

What is claimed is:

1. Adjustable support apparatus for a rifle in a shooting position in a window of a wall, comprising:

an elongated member having a forward end including a first pivot part and a rearward end;

a forward support assembly pivotably attached to the forward end of the elongated member; and a rearward support assembly, including a rifle stock support and a sliding adjustment collar joined by a turnbuckle coupling therebetween, slidingly installed on the rearward end of the elongated member; wherein the forward support assembly includes an adjustable transverse clamp mechanism for supporting the rifle on a sill member of a window, a rifle barrel support, and a transverse adjustment brace for elevation and azimuth of the longitudinal axis of the rifle; and the rearward support assembly includes the rifle stock support for resisting recoil and adjustments for the length and height of the rifle.

2. The apparatus of claim 1, wherein:

the longitudinal axes of the elongated member and the rifle are disposed in a substantially horizontal orientation.

3. The apparatus of claim 1, wherein the elongated member comprises:

a first rigid member having a rectangular or triangular cross section, a length similar to a substantial portion of the length of the rifle to be supported by the apparatus, and a first pivot part at the forward end of the first rigid member.

4. The apparatus of claim 1, wherein the forward assembly further comprises:

a second rigid member having a second pivot part extending rearward from the lower end thereof and the adjustable transverse clamp mechanism attached transverse to its upper end for supporting the apparatus securely on a window sill;

the transverse adjustment brace adjustably connected to the second rigid member above the lower end thereof for adjusting the elevation angle of the rifle; and the second pivot part configured to cooperate with the first pivot part of the elongated member in pivotably supporting the forward end to enable adjustment of the azimuth angle of the elongated member.

5. The apparatus of claim 4, wherein the second pivot part comprises:

first and second parallel arms extending rearward from the lower end of the second rigid member.

6. The apparatus of claim 1, wherein the adjustable transverse clamp mechanism comprises:

a vise formed by a fixed jaw at the upper end of the second rigid member and a movable transverse jaw slidingly disposed along a horizontal rail extending forward from the fixed jaw; wherein the movable transverse jaw and a downward extension thereof is caused to move along the horizontal rail by a first adjusting screw connecting the fixed jaw to matching internal threads in the movable jaw, to enable clamping a window sill in the vise.

7. The apparatus of claim 6, wherein:

the first adjusting screw includes a first adjusting knob.

8. The apparatus of claim 4, wherein the adjustable transverse clamping mechanism comprises:

a fixed jaw attached to the upper end of the second rigid member and a movable transverse jaw slidingly disposed along a horizontal rail extending from the fixed jaw thereby forming a vise;

wherein a screw disposed parallel to the rail and though the fixed jaw is threadably engaged with the movable transverse jaw to enable tightening or loosening the vise by turning a knob attached to the screw.

9. The apparatus of claim 1, wherein the rifle barrel support comprises:

a U-shaped yoke extending upward from a swiveling post disposed on top of the adjustable clamp mechanism.

10. The apparatus of claim 4, wherein the adjustment for elevation comprises:

a transverse adjustment brace disposed across the forward side of the second rigid member and below the upper end thereof, the transverse adjustment brace movable forward or rearward to adjust the distance between the lower end of the second rigid member and the wall below the window sill, thereby varying the angle of elevation of the longitudinal axis of the elongated member.

11. The apparatus of claim 10, wherein:

the transverse adjustment brace is coupled to the second rigid bar by a sliding bracket attached to the transverse adjustment brace and adjustable by an adjusting screw turned by a second adjusting knob supported by the sliding bracket.

12. The apparatus of claim 1, wherein the rearward support assembly comprises:

the sliding adjustment collar with a set screw, the collar configured for sliding along the elongated member for adjusting the position of the rearward assembly along the elongated member, the collar further having a first threaded rod extending upward from the collar;

the rifle stock support for retaining the rifle stock and limiting side-to-side and rearward motion thereof, and a second threaded rod of opposite thread from the first threaded rod extending downward from the stock saddle; and the turnbuckle coupling for joining distal ends of the first and second threaded rods for adjusting the distance between the collar and stock saddle, such that the stock saddle is positioned above the collar and elongated member, to adjust the height of the rifle stock relative to the elongated member.

13. The apparatus of claim 12, wherein:

the first threaded rod comprises a bolt having a left hand thread pitch; and the second threaded rod comprises a bolt having a right hand thread pitch.

14. The apparatus of claim 12, wherein the set screw comprises:

a third knob attached to the set screw for turning the set screw to secure or loosen the collar along the elongated member.

15. The apparatus of claim 1, wherein the elongated member comprises:

a first rigid member having a length similar to a substantial portion of the length of the rifle to be supported by the apparatus, and a first pivot part at the forward end of the first rigid member.

16. The apparatus of claim 10, wherein the stock support comprises:

a lining to cushion the rifle stock; and a strap for securing the rifle stock within the stock saddle.

17. The apparatus of claim 16, wherein the strap includes:

first and second parts of a hook and loop fastener.

18. The apparatus of claim 9, wherein the U-shaped yoke includes:

a cladding of cushion material.

19. The apparatus of claim 4, wherein:

the first and second pivot parts cooperate to permit horizontal movement and orientation of the elongated member relative to the second rigid member.

20. The apparatus of claim 19, wherein:

the first and second pivot parts are pivotably joined by a pin oriented substantially parallel to the second rigid bar.

21. The apparatus of claim 20, wherein:

the pin comprises a bolt secured through respective holes in the first and second arms aligned with a corresponding hole in the forward end of the elongated member.

22. The apparatus of claim 1, wherein the apparatus may be disassembled for transport and storage.

* * * * *